US008697977B1

(12) United States Patent
Lysaght et al.

(10) Patent No.: US 8,697,977 B1
(45) Date of Patent: Apr. 15, 2014

(54) DYNAMIC LIGHTING FOR MUSICAL INSTRUMENT

(76) Inventors: Travis Lysaght, Hicksville, OH (US); Richard Lysaght, Hicksville, OH (US)

( * ) Notice: Subject to any disclaimer, the term of this patent is extended or adjusted under 35 U.S.C. 154(b) by 200 days.

(21) Appl. No.: 13/200,737

(22) Filed: Sep. 30, 2011

Related U.S. Application Data

(60) Provisional application No. 61/404,930, filed on Oct. 12, 2010.

(51) Int. Cl.
*G10H 1/00* (2006.01)

(52) U.S. Cl.
USPC ..... 84/626; 84/662; 84/464 R; 84/464 A

(58) Field of Classification Search
USPC ..... 84/600–602, 464 R, 464 A, 626, 662
See application file for complete search history.

(56) References Cited

U.S. PATENT DOCUMENTS 3,869,699 A * 3/1975 Haller et al. ..... 367/197
3,958,113 A * 5/1976 Termohlen ..... 362/231
4,353,008 A * 10/1982 Dorfman ..... 315/114
4,563,933 A * 1/1986 Kim ..... 84/267
5,056,399 A * 10/1991 Hornstein ..... 84/464 R
5,557,424 A * 9/1996 Panizza ..... 386/228
5,796,025 A * 8/1998 Haake ..... 84/464 R
5,922,981 A * 7/1999 Ballister ..... 84/464 A
6,997,772 B2 2/2006 Fong
7,165,857 B2 1/2007 Fong
7,228,190 B2 * 6/2007 Dowling et al. ..... 700/94
7,476,140 B1 1/2009 Hendrickson
7,594,843 B2 9/2009 Vetuskey
2006/0027081 A1 * 2/2006 Chang et al. ..... 84/645
2007/0028746 A1 * 2/2007 Herring ..... 84/322
2010/0026624 A1 2/2010 Bell
2011/0025912 A1 2/2011 Regler

* cited by examiner

*Primary Examiner* — David S. Warren
(74) *Attorney, Agent, or Firm* — Emch, Schaffer, Schaub & Porcello Co., L.P.A.

(57) ABSTRACT

This display is a light-emitting display that is capable of creating unique and/or pleasing visual effects. It incorporates a light-emitting diode (LED) display into a sound-generating portion of a sound-generating system. The two are interactive with each other. The idea behind this product line is to create a circuit that "listens" to the music that is being played, and then changes the output state of several lights or LEDs based on the pulses that are being generated by the music. The lights or LEDs would be embedded directly into the musical instrument or speaker cabinet.

17 Claims, 6 Drawing Sheets

DYNAMIC LIGHTING FOR MUSICAL INSTRUMENT

CROSS REFERENCE

This application claims the benefit of provisional application No. 61/404,930 filed Oct. 12, 2010.

FIELD OF THE INVENTION

This invention relates to a sound generating system that includes a light-emitting device. The light-emitting device is configured to display illumination or images based on the sounds generated by the sound generating system.

BACKGROUND OF THE INVENTION

Musicians who have played many gigs in small clubs and other venues, understand the importance of showing a little "flair" during their shows. They also understand that with limited pay for these outings and also little set-up space it can be very difficult to set-up and operate a light show for the musical act. Also the time involved in setting it up and tearing it down also can be a hurdle.

A need exists for a series of products that would make a live band's performance visual stimulating, inexpensive, and simple/automatic to operate.

SUMMARY OF THE INVENTION

The present invention is a light-emitting display that is capable of creating unique and/or pleasing visual effects. The present invention incorporates a light-emitting diode (LED) display into a sound-generating portion of sound-generating system. The two are interactive with each other.

The idea behind this product line is to create a circuit that "listens" to the music that is being played, and then changes the output state of several lights or LEDs based on the pulses that are being generated by the music. The lights or LEDs would be embedded directly into the musical instrument or speaker cabinet.

IN THE DRAWINGS

DETAILED DESCRIPTION OF THE INVENTION

This invention is a series of products that would make a live band's performance visually stimulating, inexpensive, and simple/automatic to operate.

This invention creates a circuit that "listens" to the music that is being played, and then changes the output state of several lights or LEDs based on the pulses that are being generated by the music. The lights or LEDs would be embedded directly into the musical instrument or speaker cabinet.

With a drum-kit, one embodiment lines the rim of the bass drum hoop with lights or LEDs that are being controlled by the HoopLite™ circuit. As the drums are being played the state of the LEDs or lamps changes automatically with the rhythm that the drummer is playing.

Most electric guitars are equipped with pick-guards. Another embodiment integrates the LEDs directly into one of the layers of the pick-guard. Also, in this instance of the invention, either a microphone could pick up the audio changes or the guitar's pickup could be integrated directly into the circuit eliminating the need for a microphone input.

Another embodiment incorporates the circuit into the speaker enclosures. Very often, circular speaker grill covers are used to protect the speakers in guitar amplifiers, bass amplifiers, and other speaker enclosures. Those speaker grill covers could have LEDs or lamps integrated directly into their outer rim. Once again the HoopLite™ circuit could be employed to create a light show automatically making these enclosures a visual part of the show.

Often when acoustic guitars are used in live settings, a sound hole plug is used to keep the acoustic guitar from feeding back when using high volumes. The sound hole plug could be altered to incorporate some lights or LEDs and be controlled by the HoopLite™ circuit. With an acoustic guitar, a microphone could be used to pick-up audio signals, or the guitar's transducer could be the analog input into the HoopLite™ circuit.

Figure 1:
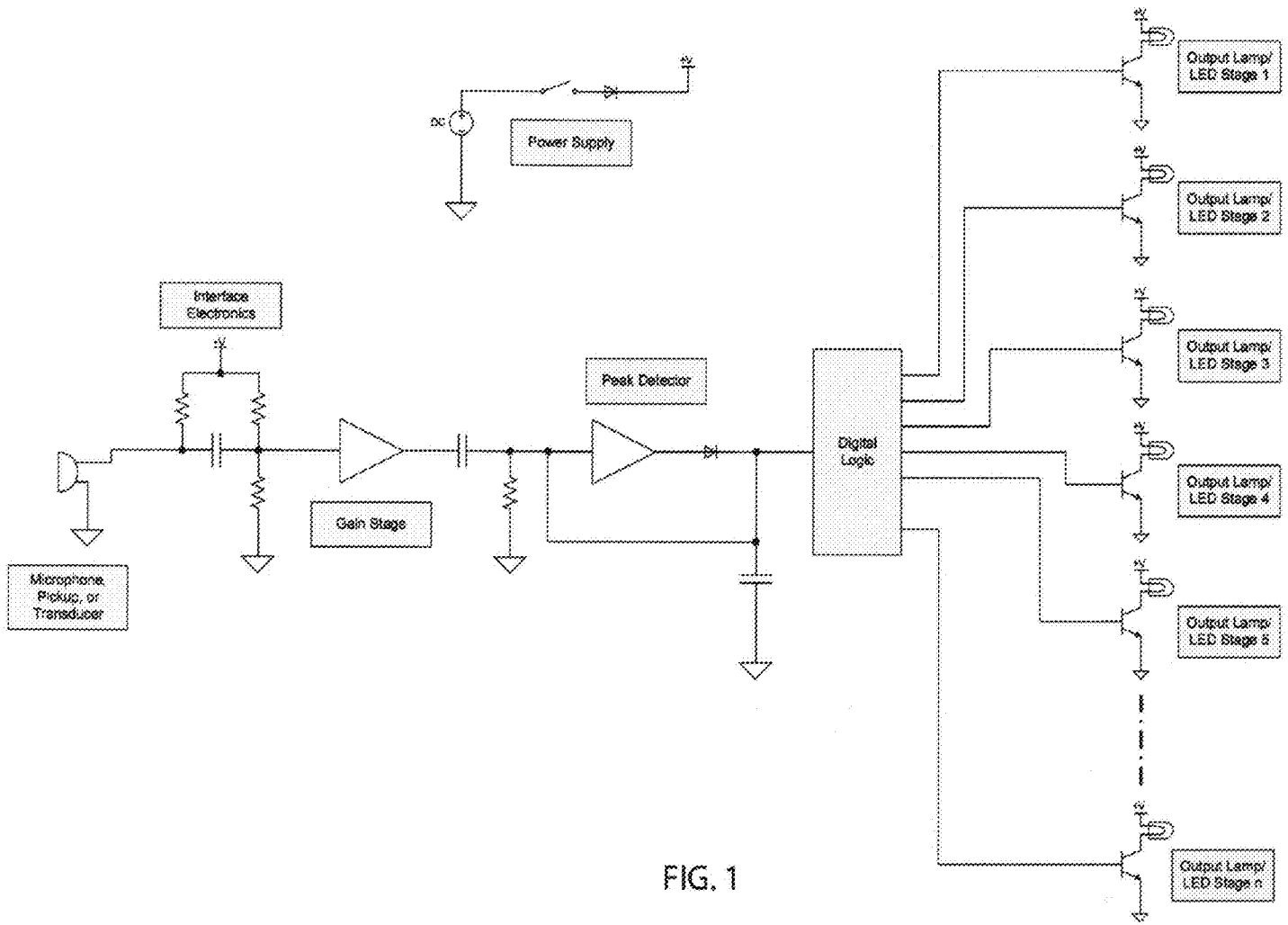
FIG. 1 is a block diagram for a circuit according to this invention.

FIG. 1 is a block diagram for a circuit according to this invention. The HoopLite™ circuit consists of (but is not limited to), a power supply, an analog sensor (microphone, guitar pick-up, piezoelectric transducer, etc.) interface electronics, gain stage, peak detector, digital logic, output drivers, and some form of light (incandescent lamp, LED, etc.).

Power Supply: The power for this circuit might be a battery, a DC source (wall-outlet power supply), or AC power that is rectified to suit the circuit.

Analog Sensor: Many different sensors could act as the input for this circuit. A microphone, guitar pick-up, or piezoelectric pick-up could all be used very simply with this product.

Interface Electronics: The interface electronics exist to couple the analog sensor to the rest of the circuitry. A guitar pickup may be connected almost directly. So, the interface electronics may change slightly based on the device that is capturing the analog (sound) input.

Gain Stage: The gain stage on this circuit amplifies the incoming audio signal. The gain stage is adjustable so that the sensitivity of the circuit can be set which controls how active the changes at the output of the device are. The gain stage is also there to start "clipping" the incoming analog signal. The clipping is the first step in the analog signal becoming a DC pulse train.

Peak Detector: The peak detector does the rest of the work in converting the "peaks" it sees coming from the gain stage into digital pulses that will become the input into the digital logic stage.

Digital Logic: Digital logic is a fairly generic term that covers many devices. In a very simple version of the circuit, the digital logic might be a decade counter where each pulse received from the peak detector changes the output state of the decade counter turning on a different light/LED.

The digital logic block might also be replaced with a microprocessor or micro-controller. In this variation of the circuit, the microprocessor might be programmed with one or many different algorithms that would control the output lights/LEDs in different fashions depending upon the algorithm that was currently employed and the input of pulses.

Output Lamps: Once again, the lights in this design could be incandescent lamps or LEDs. These lamps or LEDs might be directly on the circuit board or they may be remote so that the multiple circuit boards with lights on them might be spread around a physical structure (i.e. bass drum hoop etc.) enlarging the effect. For a very large effect AC bulbs may need to be used. In this case the Triacs could be employed as the lamp drivers allowing theater style lighting to be used.

Figure 2:
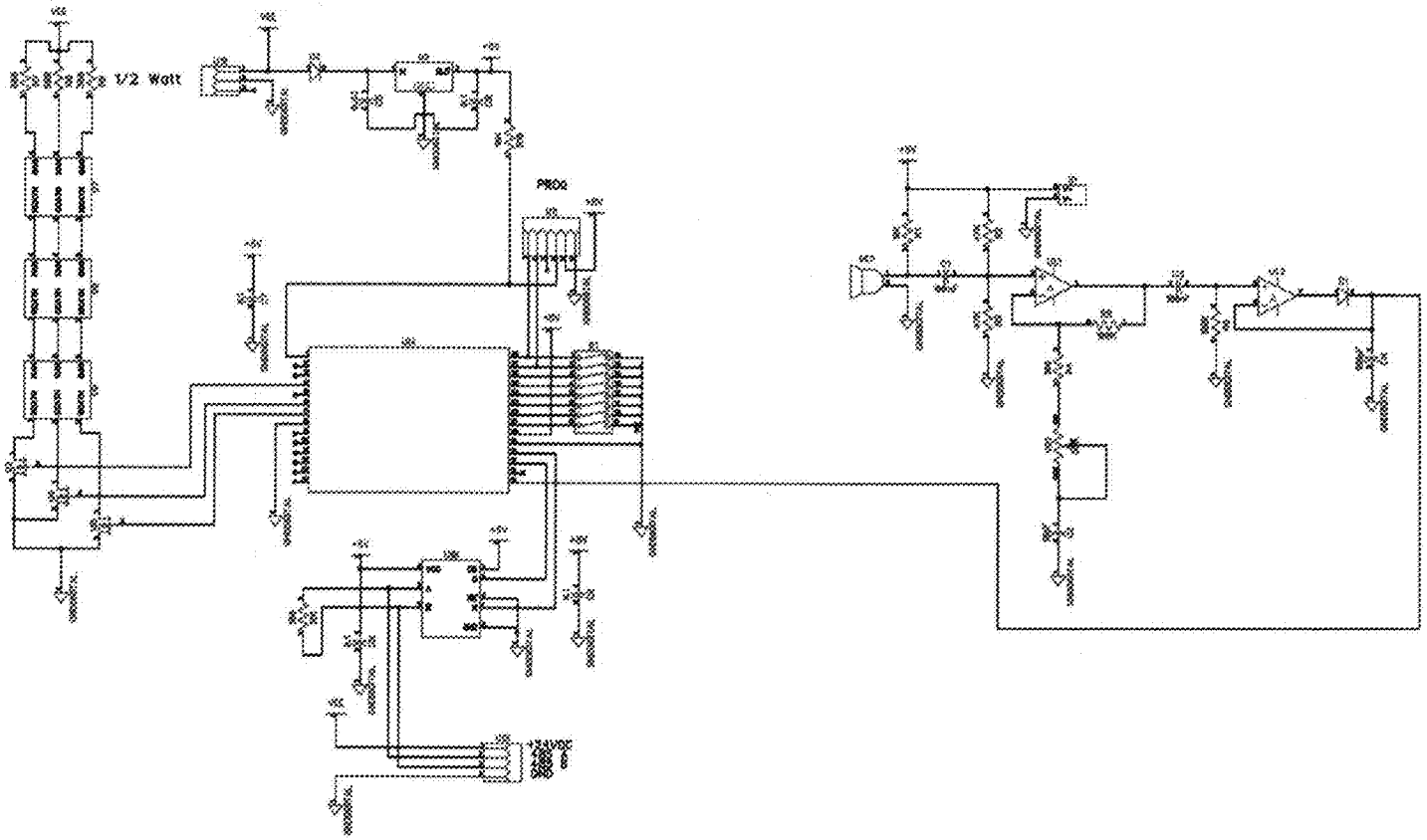
FIG. 2 is a schematic of the HOOPLITE™ LED main board.

FIG. 2 is a schematic of the HOOPLITE™ LED main board (master board).

Figure 3:
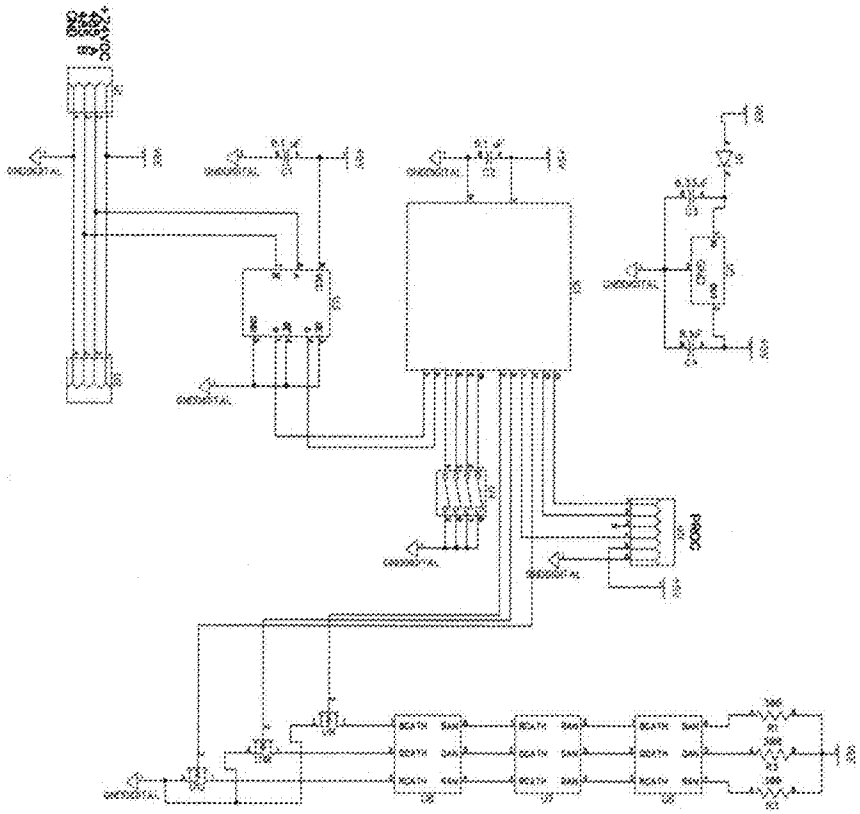
FIG. 3 is a schematic of the HOOPLITE™ control and light board.

FIG. 3 is a schematic of the HOOPLITE™ control and light board (slave board).

This invention uses a Master/Slave concept. Where the Master board of FIG. 2 has the analog listening circuit on it and a microprocessor U14. Dip-switches K1 on the Master board defines the number of boards in the hoop, which pattern to display when sound is heard, and which pattern to display when it is silent.

The Slave boards of FIG. 3 have a microprocessor ICI on them. They also have a dip-switches U4 to set their address. There is a digital protocol wherein the Master board sends commands to the slave boards as to what state they should be in (which lights should be on and at what intensity).

The invention uses the following patterns and protocols.

HoopLite Patterns
OFF STATE PATTERNS
==========
off
Slow Throb
Fast Throb
Spin to Fade
Fast Spin
Slow Spin
Even to odd
Even odd Throb
ON STATE PATTERNS
==========
Single Spin
Double Spin
Odd to Even
Throb on Pulse
Spin to Flash
Flash
Knight Rider
Random Address
Random Pattern
Page 1
HoopLite Serial Protocol
HOOPLITE SERIAL PROTOCOL
Date: 4-19-11
Version: 1.0.0
By: Richard G. Lysaght
Type: RS485
Baud: 115.2K
Data: 8 Data Bits
Parity: None
Stop Bits: 1
Checksum: Two's Compliment
Basic Message Structure:
==========
STX LENGTH COMMAND REDLEVEL BLULEVEL
GRNLEVEL CHECKSUM COMMANDS:
=========
0x21 ALL BOARDS RESPOND
0x2B ONLY EVEN NUMBERS RESPOND
0x2D ONLY ODD NUMBERS RESPOND
0x30 BOARD 0 RESPOND
0x31 BOARD 1 RESPOND
0x32 BOARD 2 RESPOND
0x33 BOARD 3 RESPOND
0x34 BOARD 4 RESPOND
0x35 BOARD 5 RESPOND
0x36 BOARD 6 RESPOND -continued 0x37 BOARD 7 RESPOND
0x38 BOARD 8 RESPOND
0x39 BOARD 9 RESPOND
0x3C BOARDS LESS THAN ADDRESS ON
0x3E BOARDS GREATER THAN ADDRESS ON
ALL BOARDS COMMAND:
==========
STX 0x02
LENGTH 0x07
COMMAND 0x21
REDLEVEL 0x00
BLULEVEL 0xFF
GRNLEVEL 0x00
CHECKSUM 0xD7
Note: This command would turn all boards blue led completely on.
EVEN NUMBERS COMMAND:
==========
STX 0x02
LENGTH 0x07
COMMAND 0x2B
REDLEVEL 0xFF
BLULEVEL 0x00
GRNLEVEL 0x00
CHECKSUM 0xCD
Note: This command would turn even numbered boards red led completely on.
ODD NUMBERS COMMAND:
==========
STX 0x02
LENGTH 0x07
COMMAND 0x2D
REDLEVEL 0x00
BLULEVEL 0x00
GRNLEVEL 0xFF
CHECKSUM 0xCB
Note: This command would turn odd numbered boards green led completely on.
ADDRESSED COMMAND:
==========
STX 0x02
LENGTH 0x07
COMMAND 0x33
REDLEVEL 0x00
BLULEVEL 0x80
Page 1
HoopLite Serial Protocol
GRNLEVEL 0x00
CHECKSUM 0x44
Note: This command would turn board +#3's blue led half on.
LESS THAN COMMAND:
==========
STX 0x02
LENGTH 0x08
COMMAND 0x3c
ADDRESS 0x35
REDLEVEL 0x00
BLULEVEL 0xFF
GRNLEVEL 0x00
CHECKSUM 0x86
Note: This command would turn board #1-4's blue led completely on.
GREATER THAN COMMAND:
==========
STX 0x02
LENGTH 0x08
COMMAND 0x3E The concept of this product could be employed in several different ways. This effect could add to visual performances by automatically creating a light show that is integrated directly into an instrument, speaker cabinet, or amplifier. The patterns and colors generated by this effect are only limited by the imagination of the designer.

Figure 4:
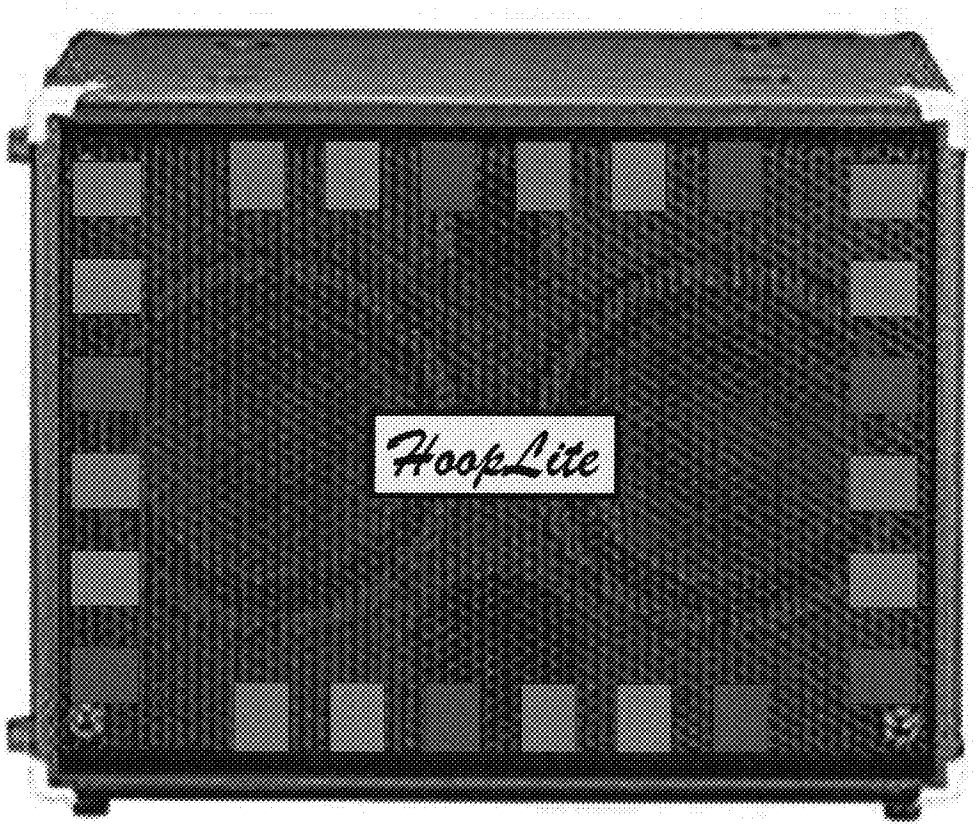
FIG. 4 is an illustration of a speaker cabinet with the HOOPLITE™ display thereon.

FIG. 4 is an illustration of a speaker cabinet with the HOOPLITE™ display thereon.

Figure 5:
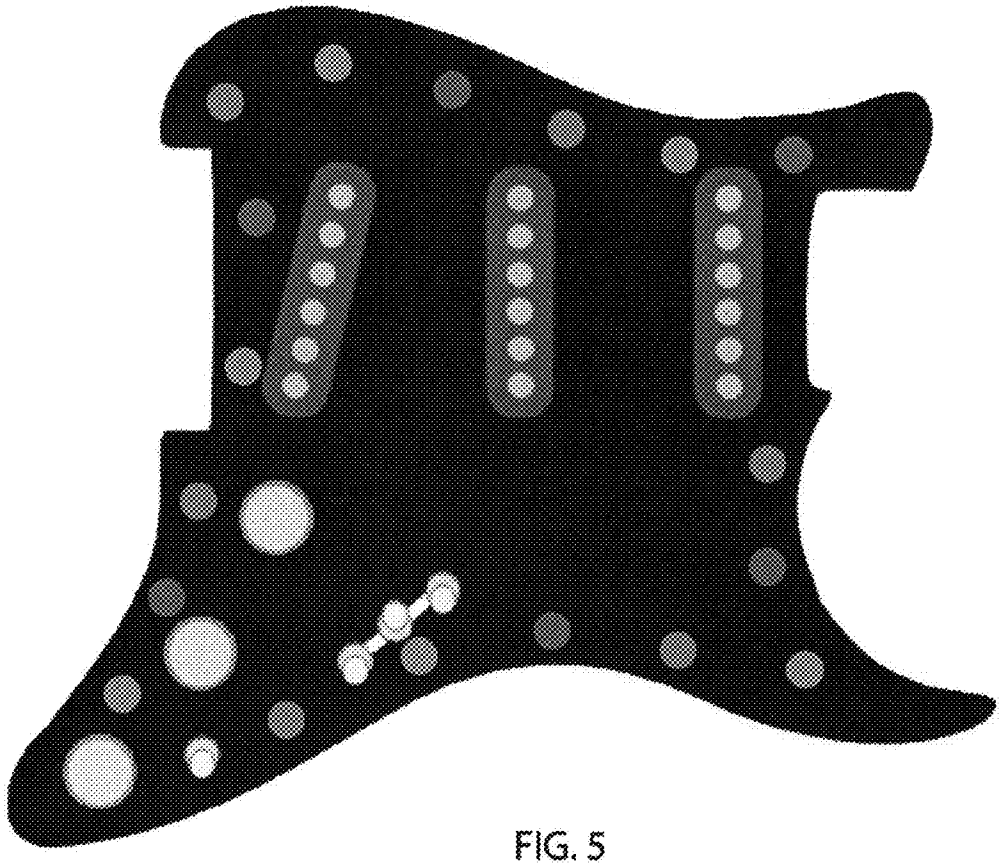
FIG. 5 is an illustration of Strat Style Guitar Pickguard with HOOPLITE™ LEDs displayed thereon.

FIG. 5 is an illustration of Strat Style Guitar Pickguard with HOOPLITE™ LEDs displayed thereon.

Figure 6:
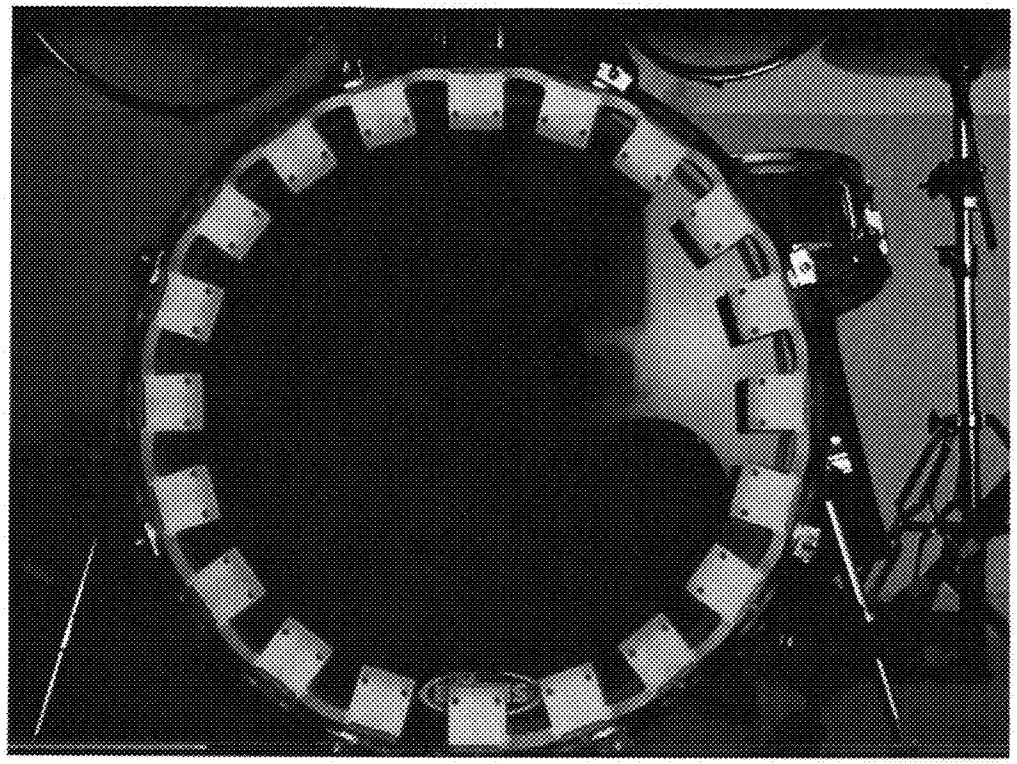
FIG. 6 is an illustration of a drum with the HOOPLITE™ LEDs displayed thereon.

The instruments in FIGS. 4-6 have 8 "ON" state patterns that the user can select from when the circuit is actively "hearing" sounds.

They also have 8 "OFF" state patterns that the user can select to have displayed when the circuit is at rest (not "hearing" any sounds).

In addition to these embodiments, persons skilled in the art can see that numerous modifications and changes may be made to the above invention without departing from the intended spirit and scope thereof.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A sound generating system comprising:

a sound generating device configured to generate sounds;

a light-emitting device configured to generate illumination patterns;

a power supply;

an analog sensor;

interface electronics configured for measuring the generated sounds and converting the generated sound into electrical signals;

a gain stage;

a peak detector; and digital logic, wherein the digital logic is configured to identify the electrical signals representative of the generated sounds and wherein the digital logic also is configured to generate the illumination patterns of the light-emitting device in response to the electrical signals representative of the generated sounds;

wherein the digital logic is a microprocessor;

wherein the microprocessor is configured to be a Master microprocessor;

wherein the Master microprocessor creates commands that are transferred digitally to slave boards;

wherein the Master microprocessor further comprises an analog listening circuit, a microprocessor U14, and Dip-switches K1 configured to define a number of boards in the light-emitting device, which pattern to display when sound is heard, and which pattern to display when silent; and wherein the slave boards further comprise a microprocessor 1C1, dip-switches U4 and configured with a digital protocol configured to receive commands from the Master board.

2. A sound generating system according to claim 1 wherein the analog sensor measures the generated sounds of the sound generating device.

3. A sound generating system according to claim 1 wherein the analog sensor is a microphone, guitar pick-up, or piezo-electric pick-up.

4. A sound generating system according to claim 1 wherein the system is a circuit and the interface electronics couple the analog sensor to the circuit.

5. A sound generating system according to claim 1 wherein the interface electronics are configured to convert the analog sensors output into electrical signals.

6. A sound generating system according to claim 1 wherein the gain stage is configured to amplify the electrical signals from the interface electronics.

7. A sound generating system according to claim 3 wherein the gain stage is further configured to clip the electrical signals.

8. A sound generating system according to claim 7 wherein the clipping is a first step in the electrical signals becoming a DC pulse train.

9. A sound generating system according to claim 1 wherein the light-emitting device is incorporated into the sound generating device.

10. A sound generating system according to claim 1 wherein the light-emitting device is interactive with the sound-generating device.

11. A sound generating system according to claim 1 wherein the light-emitting device is embedded directly into the sound-emitting device.

12. A sound generating system according to claim 1 wherein the sound-emitting device is a musical instrument.

13. A sound generating system according to claim 1 wherein the sound-emitting device is a drum, an acoustic guitar, electric guitar, bass guitar, keyboard, speaker cabinet, or amplifier.

14. A sound generating system according to claim 1 wherein the light-emitting device is a plurality of lamps or LEDs.

15. A sound generating system according to claim 1 wherein the system is further comprised of a magnetic guitar pickup configured to create the electrical signals representative of the generated sounds.

16. A sound generating system according to claim 1 wherein the system is further comprised of a piezo electric guitar pickup configured to create the electrical signals representative of the generated sounds.

17. A sound generating system according to claim 1 wherein the Slave boards have microprocessors that are capable of receiving the digital commands and convert those commands into a color and intensity setting for driving their LEDs.

* * * * *